US005907997A

United States Patent [19]

Jackson et al.

[11] Patent Number: 5,907,997

[45] Date of Patent: Jun. 1, 1999

[54] MULTI-COLOR PRINTING PRESS FOR PRINTING SINGLE OR DUAL WEBS

[75] Inventors: Dale Hiett Jackson, Newmarket, N.H.; Mark Bernard Dumais, Kennebunk, Me.; Michael Robert Lemelin, Dover, N.H.

[73] Assignee: Heidelberger Druckmaschinen AG, Heidelberg, Germany

[21] Appl. No.: 09/074,261

[22] Filed: May 7, 1998

[51] Int. Cl.[6] ..... B41F 5/16

[52] U.S. Cl. ..... 101/180; 101/179

[58] Field of Search ..... 101/180, 179, 101/178, 177, 190; 270/4, 20.1

[56] References Cited

U.S. PATENT DOCUMENTS

| | | | |
|---|---|---|---|
| 2,104,026 | 1/1938 | Dowell | 101/180 |
| 3,032,245 | 5/1962 | George et al. | 226/39 |
| 3,329,086 | 7/1967 | Pullen | 101/177 |
| 3,556,510 | 1/1971 | Treff | 70/52.07 |
| 3,975,559 | 8/1976 | Paulson et al. | 427/146 |
| 4,366,753 | 1/1983 | Glanz et al. | 101/181 |
| 4,452,140 | 6/1984 | Isherwood et al. | 101/181 |
| 4,633,777 | 1/1987 | Germann | 101/179 |
| 5,024,156 | 6/1991 | Hank et al. | 101/216 |
| 5,361,960 | 11/1994 | Fokos et al. | 226/2 |
| 5,647,276 | 7/1997 | Tilton, Sr. | 101/219 |

*Primary Examiner*—Edgar Burr
*Assistant Examiner*—Minh H. Chau
*Attorney, Agent, or Firm*—Kenyon & Kenyon

[57] ABSTRACT

A multi-color single blanket printing press for printing single or dual webs includes a pair of blanket cylinders that are movable between a contacting position and a remote position. A plurality of plate cylinders associated with each blanket cylinder apply a multi-color image to each blanket cylinder. When the blanket cylinders are in the contacting position, a web passing through the nip will receive multi-color image on both sides. When the blanket cylinders are in the remote position, a pair of webs may be passed between secondary nips formed by the blanket cylinders and a pair of secondary impression cylinders. Each of the webs may therefore receive a multi-color image on one side.

10 Claims, 2 Drawing Sheets

MULTI-COLOR PRINTING PRESS FOR PRINTING SINGLE OR DUAL WEBS

FIELD OF THE INVENTION

The present invention relates to web-offset printing presses. Specifically, the present invention relates to a multi-color printing press capable of printing either a single web or dual webs.

BACKGROUND OF THE INVENTION

In a web-offset printing press, a blanket cylinder receives an image from a printing plate cylinder and transfers the image to a web of paper. Multi-color web offset printing presses are known which apply a multi-color image to a face of a web via a single blanket cylinder, with two blanket cylinders being employed to print both sides of the web.

In a conventional multi-color single blanket system, a plurality of plate cylinders contact each blanket, each of the plate cylinders applying a different color image to the blanket. The blankets form a nip through which a web is passed. The web receives the multi-color image from each blanket. Such a device is described in U.S. Pat. No. 4,633,777 to Germann.

In some situations, it is desirable to print the multi-color image on a single side of a web, while in other situations it is desirable to print the multi-color image on both sides. In still other situations, it may be desirable to print a multi-color image on a single side of each of two webs. Known multi-color single blanket presses are not capable of selectively printing either on both sides of a single web or single sides of two webs.

SUMMARY OF THE INVENTION

An exemplary multi-color single blanket printing press according to the present invention includes a pair of blanket cylinders each in contact with a plurality of plate cylinders, for example four plate cylinders. The plate cylinders apply a multi-color image to each blanket, which is then transferred to one or more webs.

The blanket cylinders are movable for example, from a contacting position to a remote position. In the contacting position, the blanket cylinders contact each other to form a nip, while in the remote position a gap exists between the blanket cylinders. While in the contacting position, the blanket cylinders print at the nip, printing, for example, the multi-color image on both sides of a single web passing through the nip.

The exemplary press also includes, for example, two secondary impression cylinders and two secondary rollers that work, for example, in conjunction with the secondary impression cylinders. Each of the secondary impressions cylinders contacts, for example, one of the blanket cylinders, forming two secondary nips. When the blanket cylinders are in the remote position, a webs may be passed through each of the two secondary nips, so that the blanket cylinders each print a multi-color image on a single side of each of the webs. Because the blanket cylinders are separated, one of the blanket cylinders can be slowed or stopped, for example, while printing continues on the other blanket cylinder.

The present invention advantageously permits both one or two web printing, and also reduces fan out.

DETAILED DESCRIPTION OF THE INVENTION

Figure 1:
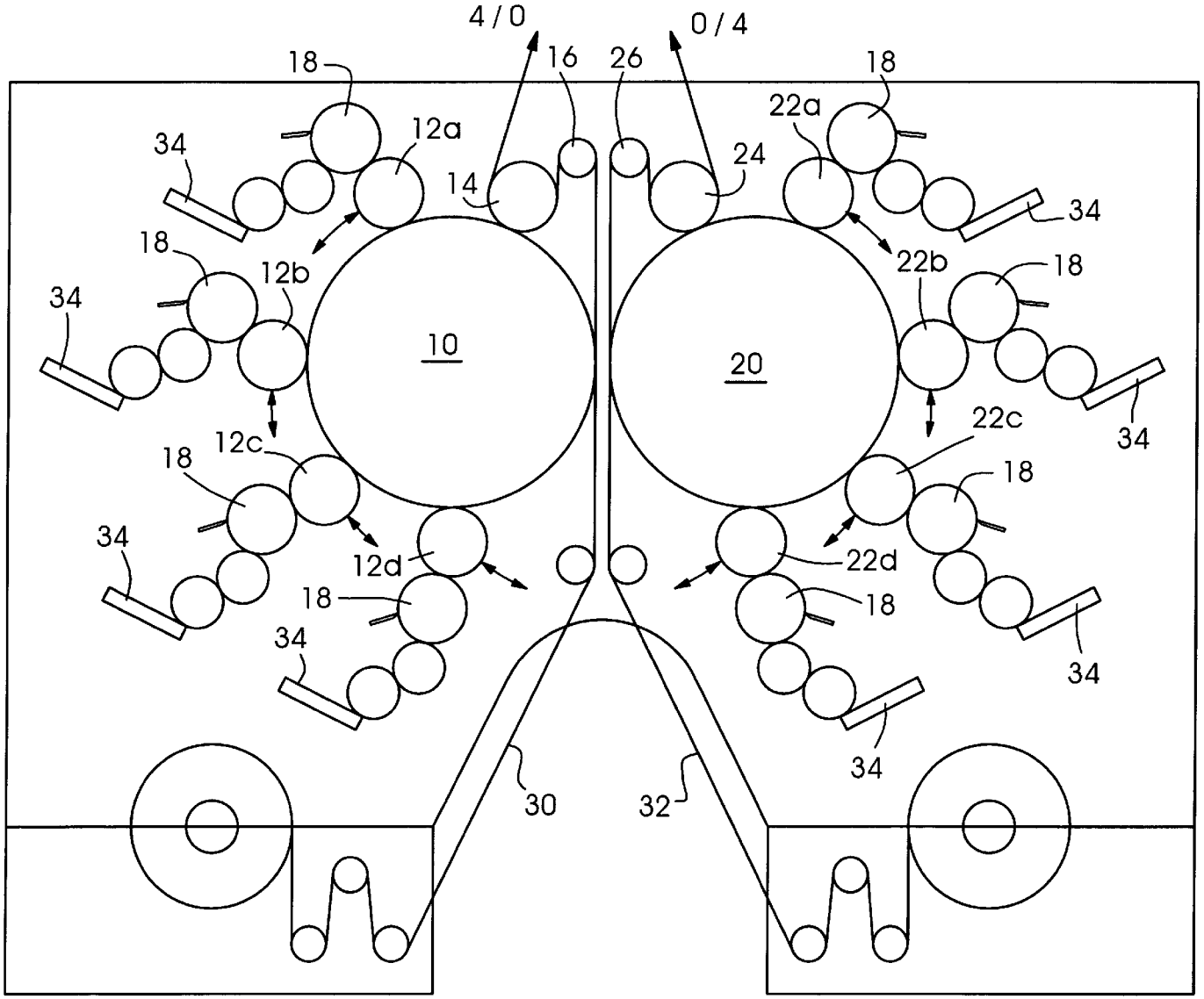
FIG. 1 is a schematic drawing of an exemplary multi-color press according to the present invention in the mode in which two webs are being printed on one side.
Figure 2:
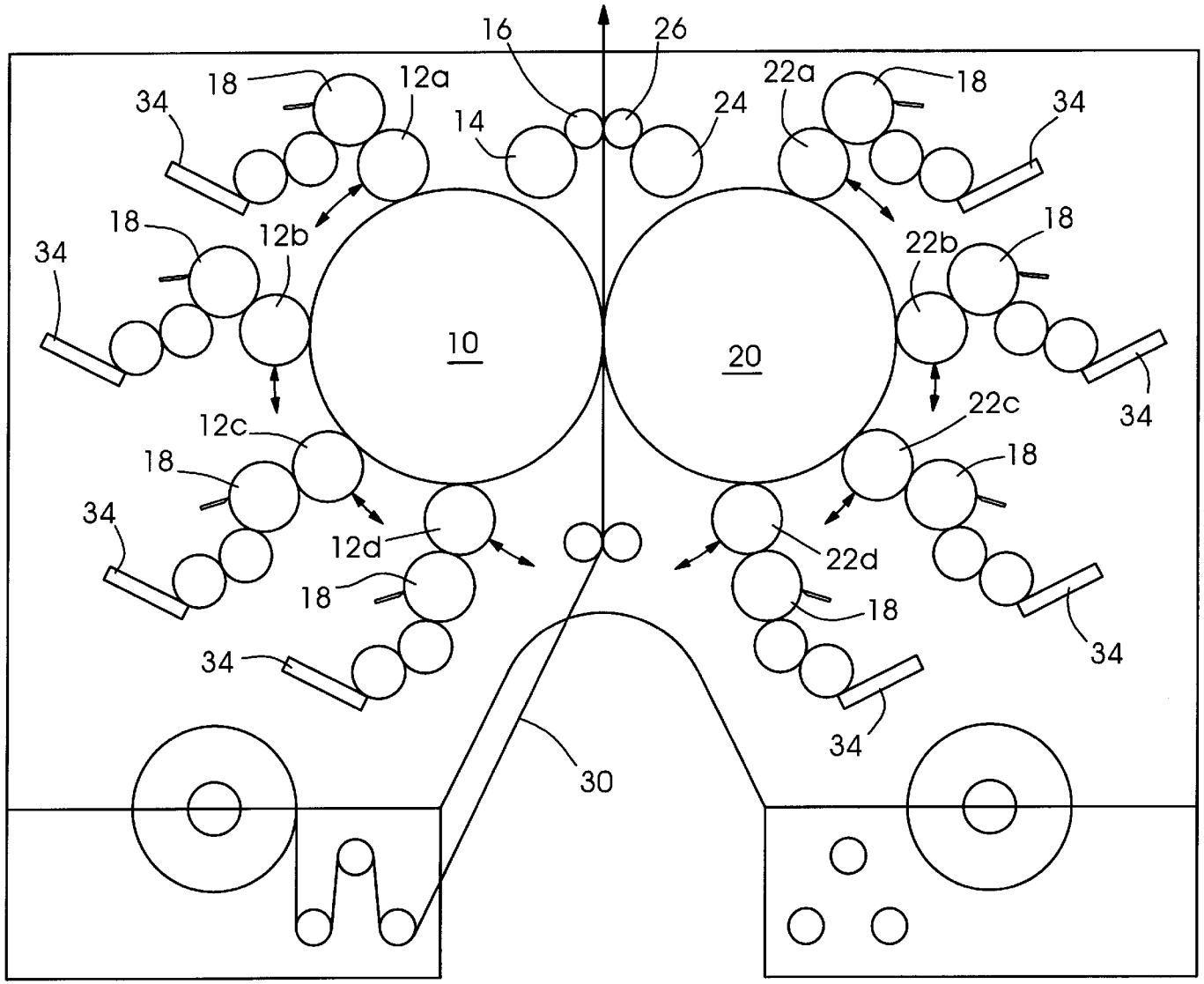
FIG. 2 is a schematic drawing of an exemplary multi-color press according to the present invention in the mode in which one web is being printed on both sides.

FIGS. 1 and 2 illustrate an exemplary embodiment of a multi-color single blanket printing press according to the present invention. FIGS. 1 and 2 illustrate, for example, a multi-color press that prints a tour-color image, either in a single-web double-sided print mode (FIG. 2). or in a dual web, single-sided print mode (FIG. 1). While the drawings and much of the description refer to this four-color press, it should be understood to include any number of colors.

The press of FIGS. 1 and 2 includes, for example, two blanket cylinders 10, 20. Blanket cylinders 10, 20 may be movable from a contacting position (FIG. 2) to a remote position (FIG. 1). In the contacting position, blanket cylinders 10, 20 form a nip for printing on both sides of a single web 30 passing between the cylinders, as shown in FIG. 2. In the remote position shown in FIG. 1, blanket cylinders 10, 20 are spaced apart, forming a gap between the two. The gap may be any suitable size, for example about one inch across. It can be understood that only one of blanket cylinders 10, 20 need be moveable to achieve the contact and remote positions, although both can be movable if desired. Accordingly, while both blanket cylinders 10, 20 are described as movable, this phrasing should be read to include an arrangement in which only one of blanket cylinders 10, 20 actually moves.

A plurality of plate cylinders, for example four plate cylinders 12*a*–12*d*, contact blanket cylinder 10, while a plurality of plate cylinders, for example four plate cylinders 22*a*–22*d* contact blanket cylinder 20. In each case, the four plate cylinders 12*a*–12*d*, 22*a*–22*d* transfer a multi-color image to the associated blanket cylinder 10, 20. It can be understood that in order for blanket cylinders 10, 20 to receive the multi-color image, the circumference of each of blanket cylinders 10, 20 may be, for example, at least four times the circumference of each of associated plate cylinders 12*a*–12*d*, 22*a*–22*d*. Plate cylinders 12*a*–12*d*, 22*a*–22*d* may also, for example, be movable as necessary to remain in contact with blanket cylinders 10, 20 in both the contacting and remote positions.

In an exemplary embodiment, plate cylinders 12*a*–12*d*, 22*a*–22*d* may each, for example be movable from a plate contacting position to a plate remote position as designed by the arrows in FIG. 1. This allows, for example, replacement of plate cylinders 12*a*–12*d*, 22*a*–22*d*. Plate cylinders 12*a*–12*d* and 22*a*–22*d* may be arranged in pairs so that one cylinder of each pair contacts its associated blanket cylinder 10, 20, while the other cylinder of each pair is in a plate remote, or offline, position.

Each of plate cylinders 12*a*–12*d*, 22*a*–22*d* is inked, for example, by inkers 18. In an exemplary embodiment, inkers 18 are keyless. In addition, inkers 18 may, for example, be remote from ink trays 34, or may receive ink directly from ink trays 34. The latter configuration permits, for example, rapid stabilization of the ink film at start-up.

The exemplar embodiment illustrated in FIG. 1 for dual web printing also includes, for example, two secondary impression cylinders 14, 24 and, for example, two secondary rollers 16, 26. Secondary impression cylinders 14, 24 contact blanket cylinders 10, 20 respectively, forming two secondary nips, N1 and N2 respectively. Secondary rollers work in conjunction with secondary impression cylinders to feed webs 30, 32 through the secondary nips N1 and N2 when desired, as discussed below.

In FIG. 1, the blanket cylinders 10, 20 are in the remote position. Two webs 30, 32 may each contact a respective inlet roller 15, 25 and then pass through gap G formed between blanket cylinders 10, 20. Since there is no pressure, even if the webs 30, 32 contact the blanket cylinders 10, 20, no printing takes place at gap G. Of course, inlet rollers 15,25 and secondary rollers 16,26 may be moveable and be designed so that contact of the webs with the blanket cylinders 10, 20 is avoided at gap G. Webs 30, 32 may then wind at least partially around secondary rollers 16 and 26, respectively, and pass through the secondary nips N1 and N2, where printing takes place. It can be understood that secondary impression cylinders 14, 24 and secondary rollers 16, 26 may be arranged, for example, so that webs 30, 32 pass through the secondary nips prior to passing between blanket cylinders 10, 20.

Upon passing through the secondary nips, webs 30, 32 will each receive a multi-color image on a single side. As shown on FIG. 1, this type of image may be designated numerically. Specifically, web 30 receives, for example a 4/0 image, signifying a four-color image on one side, while web 32 receives, for example, a 0/4 image (or more generally x/0 and 0/y images, respectively). The multi-color images may be, for example, the same image or different images. Moreover, because each set of blanket, plate, and impressions cylinders works, for example, independent of the other in this arrangement, one of the sets may be halted or slowed while the other continues to print. After webs 30, 32 pass through the secondary nips, further images may be applied to either side of either web 30,32 as desired.

As shown in FIG. 2, when blanket cylinders 10, 20 are in the contacting position, a single web (e.g. web 30) may pass through the nip N formed between the blanket cylinders 10, 20 and receive a multi-color image on both sides. In this arrangement, web 30 does not, for example, pass through either secondary nip. Rather, web 30 may pass between, for example, rollers 16 and 26 (either contacting the rollers or not, as is the case with roller 25 for web 30). Once clear of the press, web 30 may be dried, further printed, or otherwise processed as desired. It should be noted that impression cylinders 14 and 24 may (but need not) be removed from contact with the blanket cylinders 10 and 20 during this printing mode.

The device and method according to the present invention have been described with respect to several exemplary embodiments. It can be understood, however, that there are many other variations of the above described embodiments which will be apparent to those skilled in the art. It is understood that these modifications are within the teaching of the present invention, which is to be limited only by the claims appended hereto.

What is claimed is:

1. A multi-color printing press capable of printing either a first web or both the first web and a second web, comprising:

means for selectively printing multicolor images either on both sides of a single web or on one side of each of two webs, said means including:

first and second blanket cylinders, the first and second blanket cylinders being mounted for movement between a contact position, in which the first and second blanket cylinders form a nip, and a remote position, in which the first and second blanket cylinders form a gap;

a plurality of first plate cylinders, each cylinder of the plurality of first plate cylinders selectively contacting the first blanket cylinder;

a plurality of second plate cylinders, each cylinder of the plurality of second plate cylinders selectively contacting the second blanket cylinder, a first secondary impression cylinder, the first secondary impression cylinder contacting the first blanket cylinder to form a first secondary nip, and a second secondary impression cylinder, the second secondary impression cylinder contacting the second blanket cylinder to form a second secondary nip;

wherein when the first and second blanket cylinders are in the contacting position, the first web passes through the nip and receives a multi-color images on both sides; and wherein when the first and second blanket cylinders are in a remote position, one of the first web and the second web passes through the first secondary nip and receives a first image of at least one color on one side, and the other of the first web and the second web passes trough the second secondary nip and receives a second image of at least one color on one side.

2. The printing press according to claim 1, further comprising first and second secondary rollers associated with the first and second secondary impression cylinders, respectively, the first rich passing between the first and second secondary rollers when the first and second blanket cylinders are in the contacting position, and the first and second webs being would at least partially around the first and second secondary rollers when the first and second blanket cylinders are in the remote position.

3. The printing, press according to claim 1, further comprising a plurality of keyless inkers, each of the keyless inkers supplying ink to a respective one of the plurality of first and second plate cylinders.

4. The printing press according to claim 3, wherein the keyless inkers each receive ink directly from a respective one of a plurality of ink pans.

5. The printing press according to claim 1, wherein the plurality of first plate cylinders includes four first plate cylinders and the plurality of second plate cylinders includes four second plate cylinders.

6. The printing press according to claim 5, wherein each of the first and second plate cylinders includes a pair of plate cylinders, so that one of each pair of plate cylinders contacts an associated one of the first and second blanket cylinders while the other of each pair of plate cylinders is off line.

7. The printing press according to claim 5, further comprising first and second secondary rollers associated with the first and second secondary impression cylinders, respectively, the first web passing between the first and second secondary rollers when the first and second blanket cylinders are in the contacting position, and the first and second webs being wound at least partially around the first and second secondary rollers when the first and second blanket cylinders are in the remote position.

8. The printing press according to claim 5, further comprising a plurality of keyless inkers, each of the keyless inkers supplying ink to a respective one of the plurality of first and second plate cylinders.

9. The printing press according to claim 8, wherein the keyless inkers each receive ink directly from a respective one of a plurality of ink pans.

10. The printing press according to claim 1, wherein the first and second images are four-color images.

* * * * *